US005461988A

United States Patent [19]

Cummings et al.

[11] Patent Number: 5,461,988

[45] Date of Patent: Oct. 31, 1995

[54] RECYCLABLE LIGHTWEIGHT PALLET

[75] Inventors: Kasey H. Cummings, Mesa; Robert D. Champion, Phoenix, both of Ariz.

[73] Assignee: Champion Containers, Tempe, Ariz.

[21] Appl. No.: 174,528

[22] Filed: Dec. 28, 1993

[51] Int. Cl.[6] ..... B65D 19/00

[52] U.S. Cl. ..... 108/51.3; 108/56.1

[58] Field of Search ..... 108/51.1, 51.3, 108/56.1, 56.3

[56] References Cited

U.S. PATENT DOCUMENTS

| | | | |
|---|---|---|---|
| 3,301,200 | 1/1967 | Landsiedel | 108/56.1 |
| 4,424,753 | 1/1984 | Eatherton | 100/56.1 X |
| 4,841,879 | 6/1989 | Ferguson | 108/56.1 X |
| 4,863,024 | 9/1989 | Booth | 108/51.3 X |
| 5,076,176 | 12/1991 | Clasen | 108/51.3 |
| 5,170,722 | 12/1992 | Friesner et al. | 108/902 X |
| 5,207,631 | 5/1993 | Schmidtke et al. | 108/51.3 X |
| 5,218,913 | 6/1993 | Winebarger et al. | 108/51.3 |
| 5,337,679 | 8/1994 | Moorman | 108/51.3 |

*Primary Examiner*—José V. Chen

*Attorney, Agent, or Firm*—Parsons & Associates; Don J. Flickinger; Robert A. Parsons

[57] ABSTRACT

A recyclable lightweight pallet having a plurality of elongated runners and mating crosspieces. Each runner including a plurality of elongated parallel juxtaposed runner sections of fiber board, with laterally extending assembled openings defined therein and longitudinally spaced apart therealong. Each elongated parallel juxtaposed crosspiece sections of fiber board, jointly defining opposed assembled ends. Each assembled end of each crosspiece is formed to mate with an assembled opening in one of the plurality of runners, the runners and mating crosspieces forming a generally rectangular pallet.

8 Claims, 9 Drawing Sheets

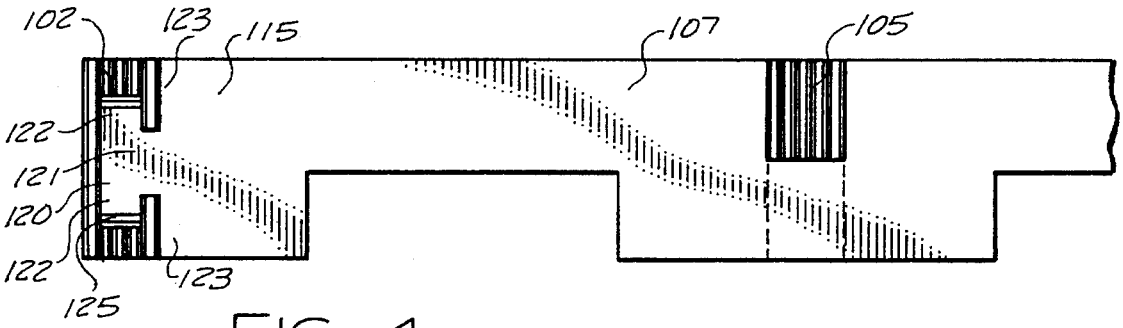
FIG. 4
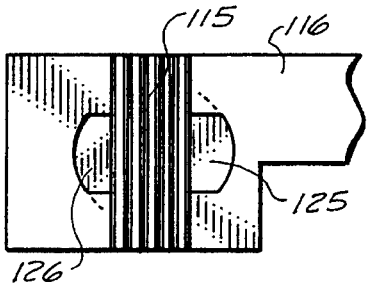
FIG. 5
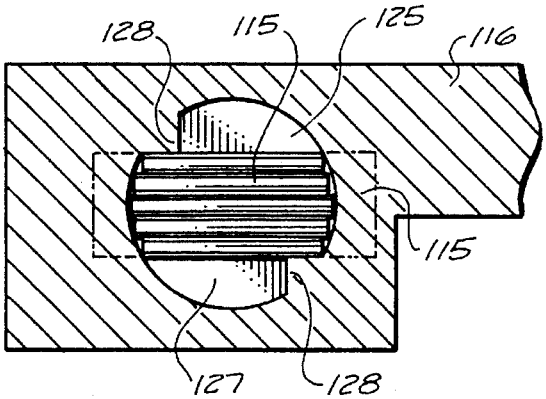
FIG. 6
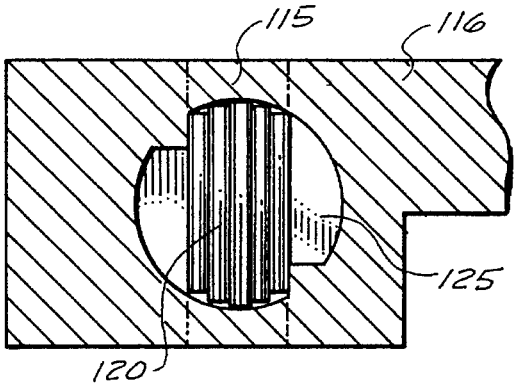
FIG. 7
FIG. 8
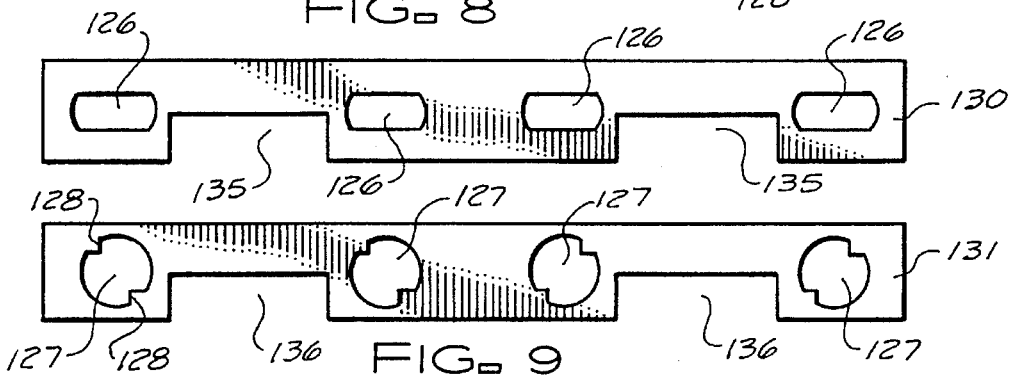
FIG. 9
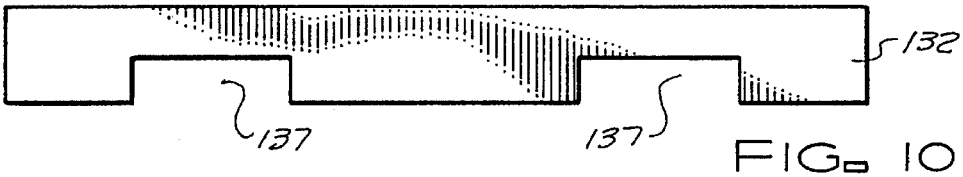
FIG. 10

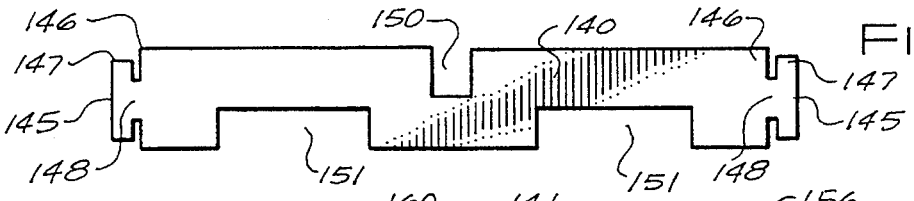
FIG. 11
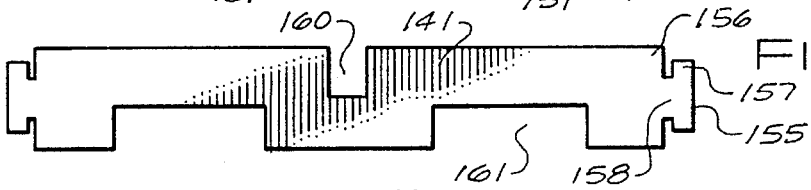
FIG. 12
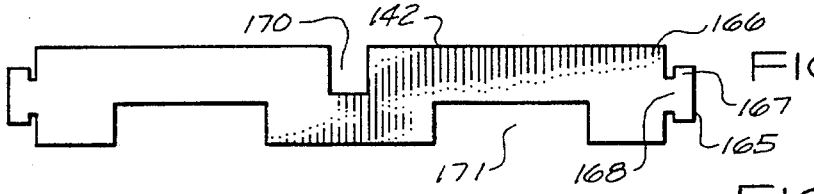
FIG. 13
FIG. 14
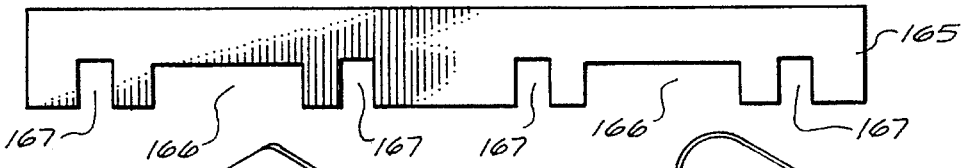
FIG. 15
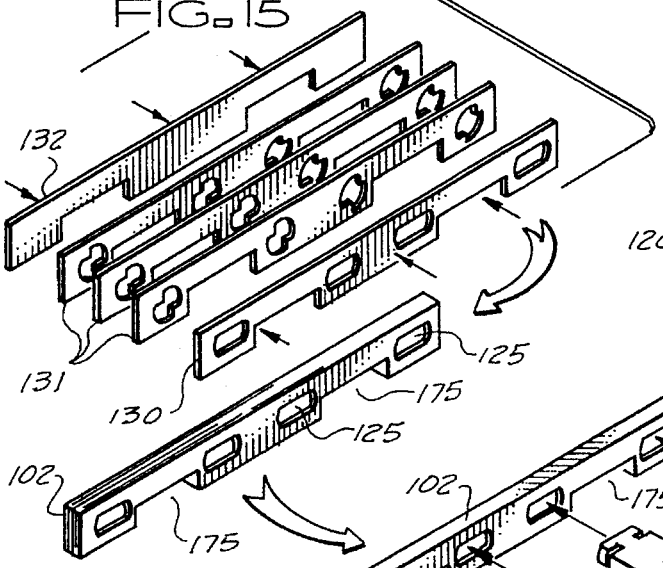
FIG. 16
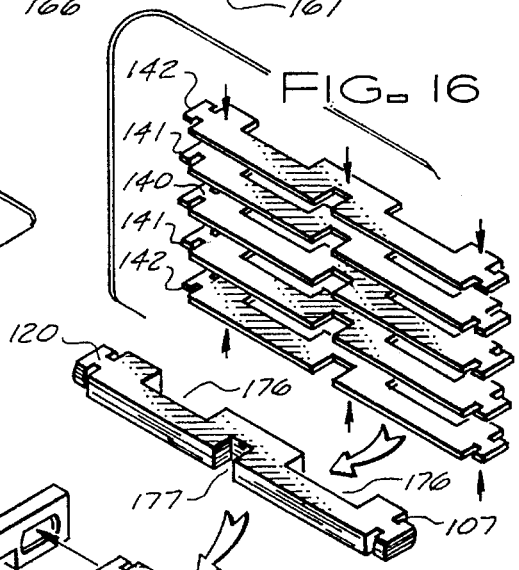
FIG. 17
FIG. 18
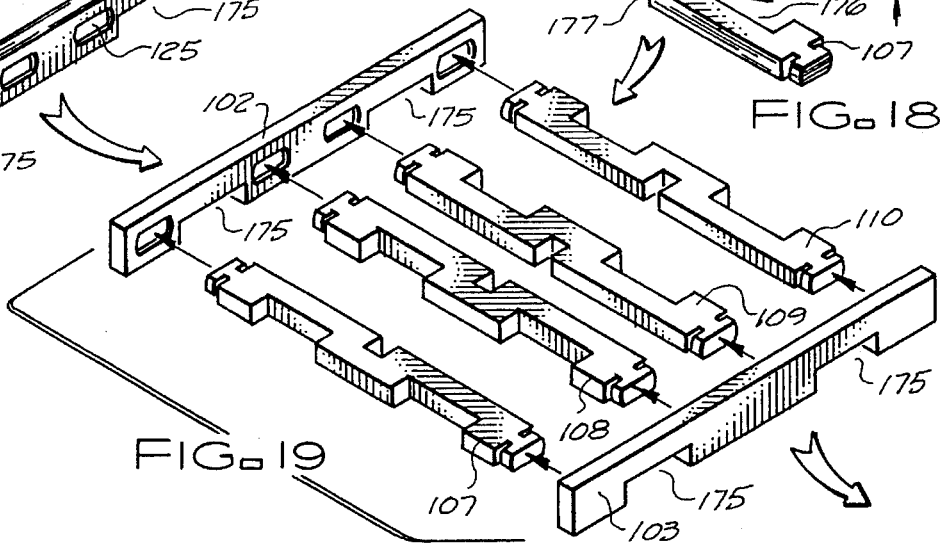
FIG. 19

180
180
100
105
102
175

181
100
176
105
176
175
102

105
102
110
109
103
107
108
180
100

100
100

FIG. 31
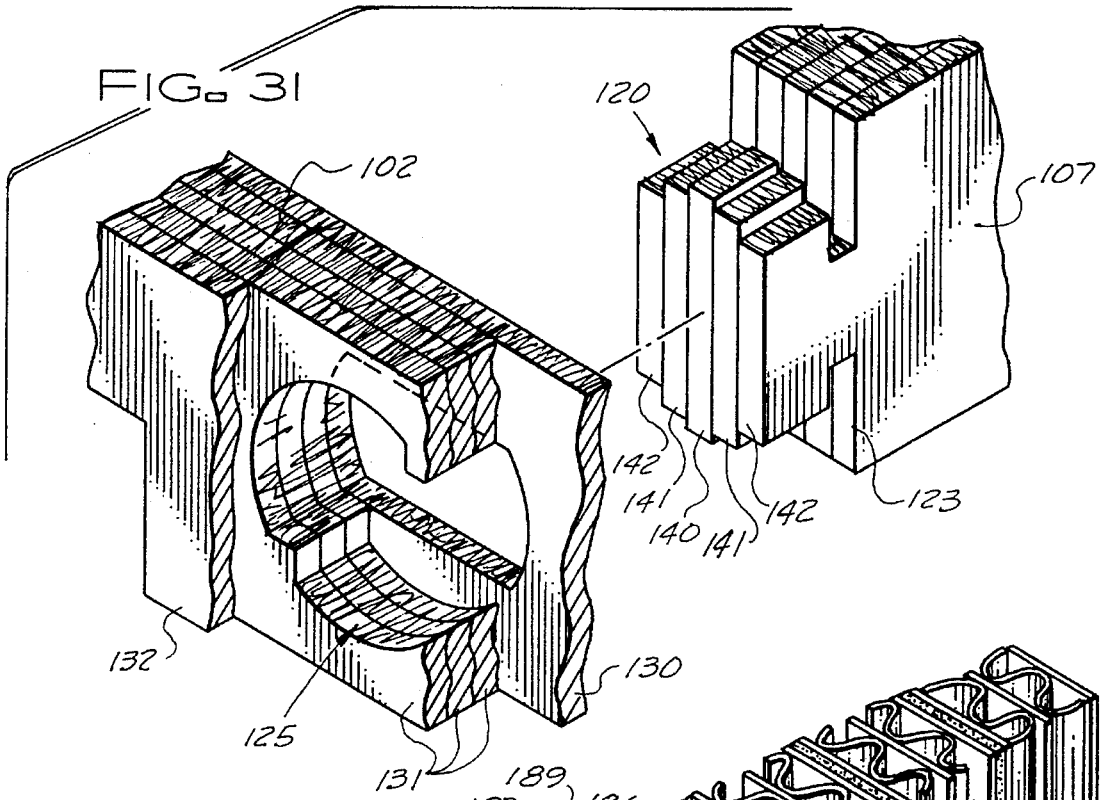
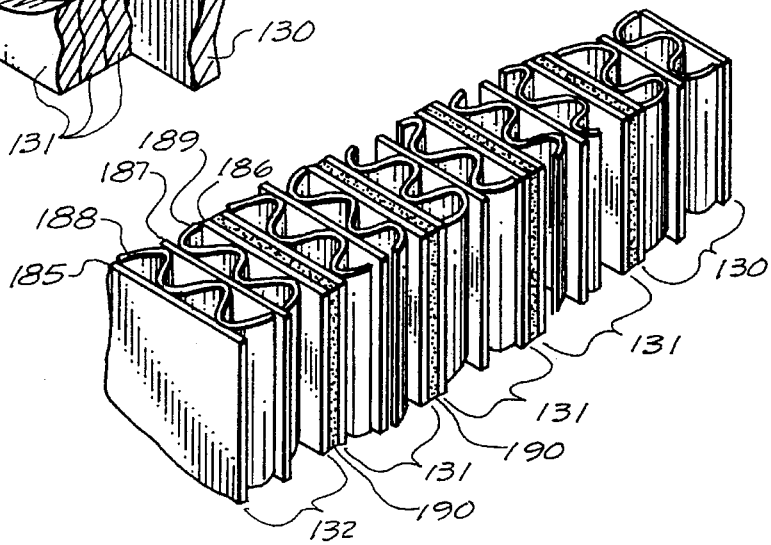
FIG. 32
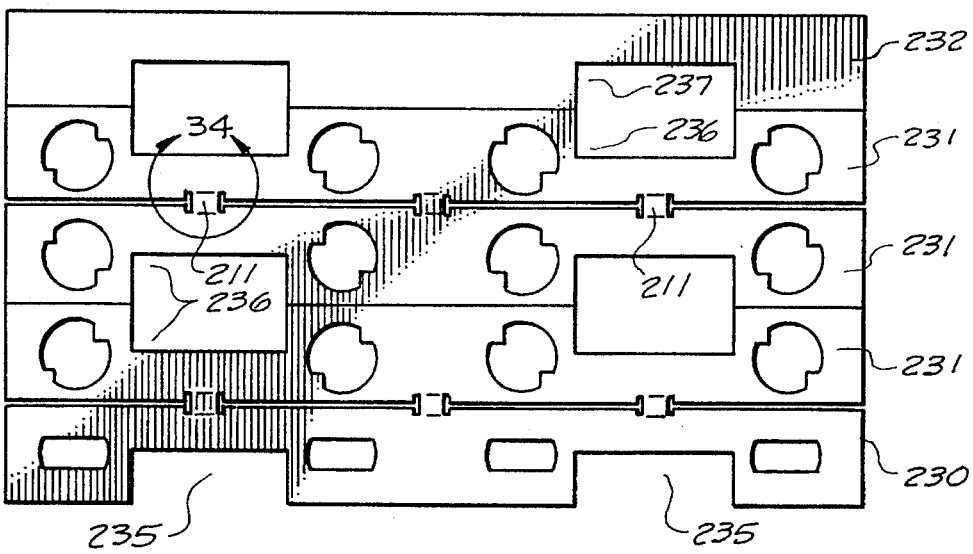
FIG. 33

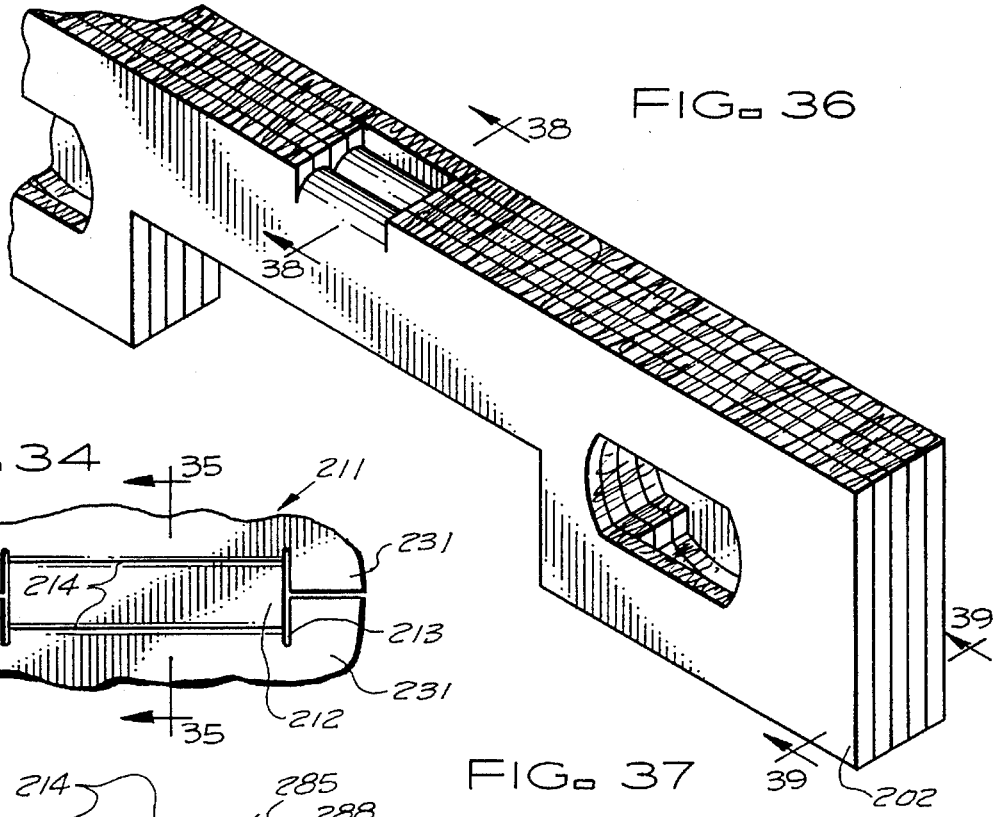
FIG. 36
FIG. 37
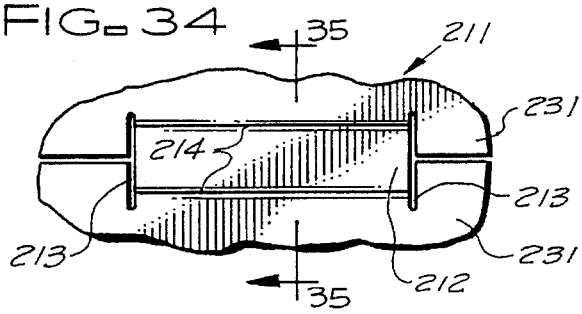
FIG. 34
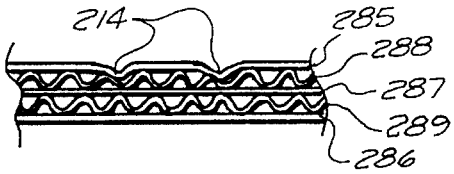
FIG. 35
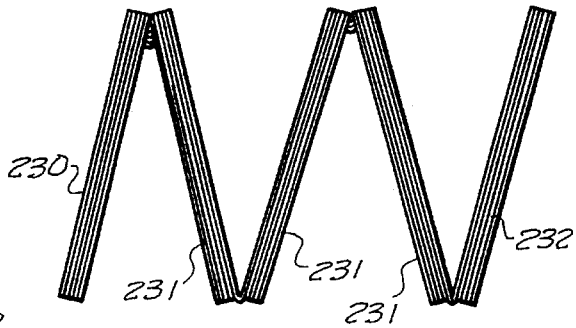
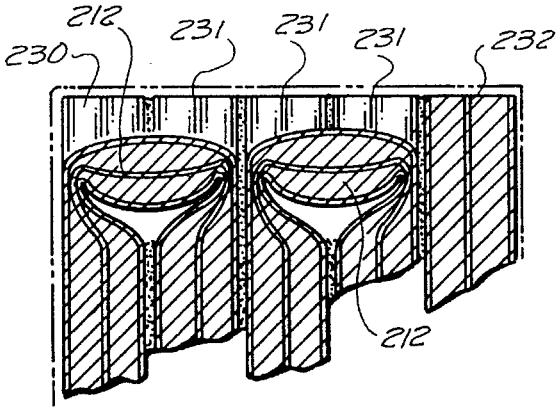
FIG. 38
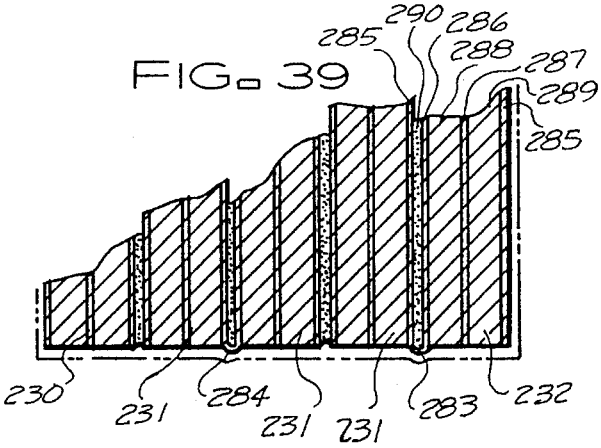
FIG. 39

FIG. 48
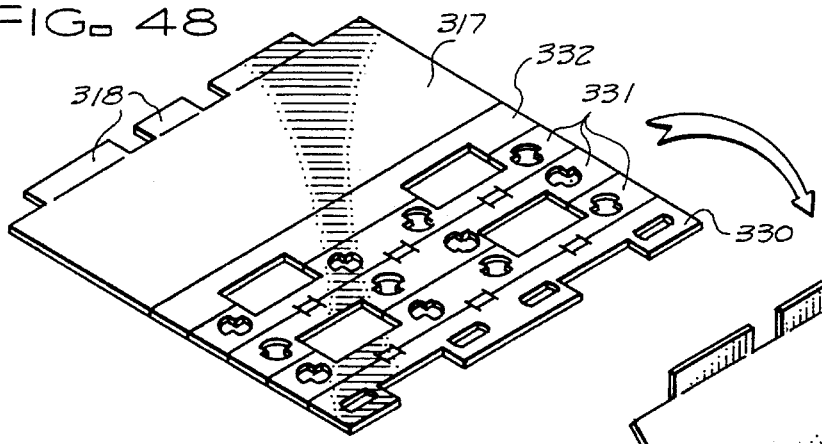
FIG. 49
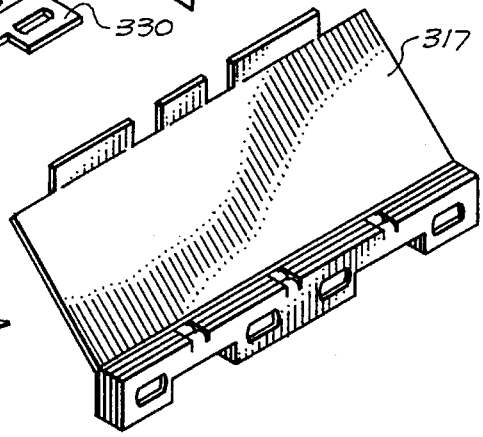
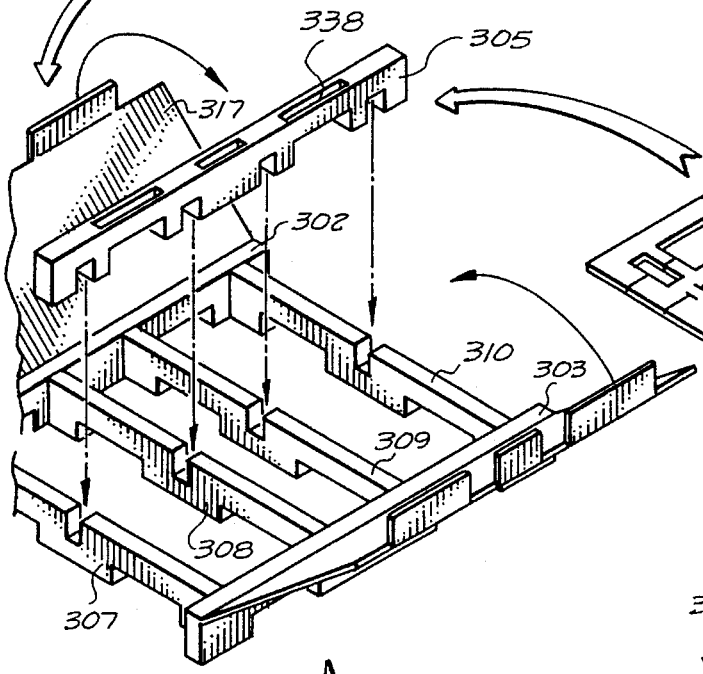
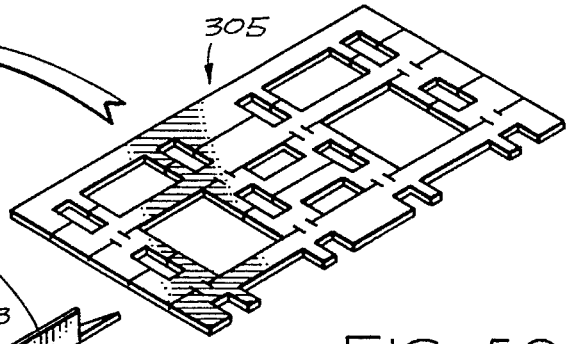
FIG. 50
FIG. 51
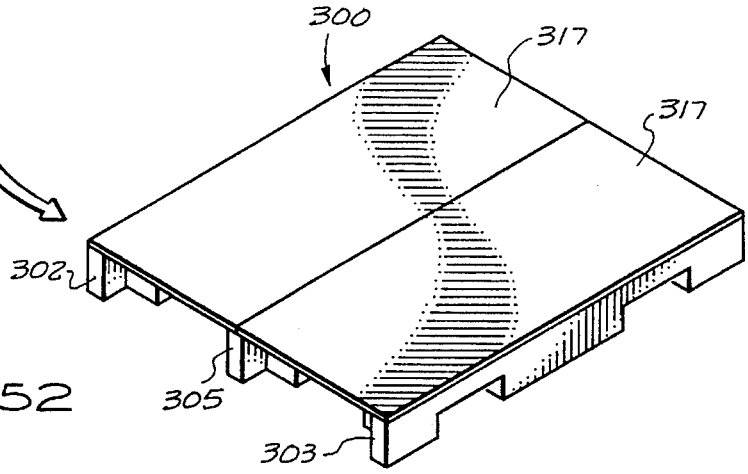
FIG. 52

RECYCLABLE LIGHTWEIGHT PALLET

BACKGROUND OF THE INVENTION

1. Field of the Invention

This invention relates to shipping pallets and the like.

More particularly, the present invention pertains to lightweight and recyclable shipping pallets.

2. Prior Art

Pallets are utilized in manufacturing and shipping industries to store and ship components and finished articles.

Items are stacked on a pallet and secured by some means, such as steel bands, wire, rope, etc. Once the pallet is completely loaded it is moved by a forklift to a storage area, or moved to a shipping area with other similarly loaded pallets. All of the loaded pallets are then moved, by forklift, to a truck or the like for shipping. At the other end the procedure is reversed.

The pallet provides an easy means of handling relatively large and heavy quantities of any specific articles. The major problems encountered are the weight and construction of the pallet. Generally, pallets are formed of relatively hard and rough finished wood joined together by nails, large staples, etc. Because the wood is rough finished (and as cheaply as possible) and because nails may work loose or protrude due to improper assembly, care must be used in loading and unloading the pallets to be sure that products shipped by the pallets are not damaged.

In some instances plastic pallets are used, however, while plastic pallets are reusable they are very expensive. Further, plastic pallets are relatively heavy and, therefore, expensive to return to original shipping points.

When the pallets are empty, care must be used in stacking and storing them to insure that workers do not receive wood slivers, cuts from protruding nails, etc. Also, before and after shipping the pallets must be stored by stacking in an out-of-the-way area which is costly and inconvenient. Because the wood pallets are relatively heavy and bulky, they are difficult for an individual to move and, therefore, valuable time and energy is wasted in moving them to and from the storage area. In many instances, the pallets are simply destroyed after use because the cost of storing and returning is so high as to be prohibitive. In such instances, it is cheaper to provide new pallets. This, however, adds substantial cost to the shipping price and is costly in natural resources.

It would be highly advantageous, therefore, to remedy the foregoing and other deficiencies and problems inherent in the prior art.

Accordingly, it is an object of the present invention to provide a new and improved shipping pallet.

Another object of the present invention is the provision of a shipping pallet that is lightweight.

And another object of the invention is to provide a shipping pallet that is easy to handle.

Still another object of the present invention is the provision of a shipping pallet that is relatively inexpensive to store and ship.

Yet another object of the present invention is the provision of a shipping pallet that is relatively inexpensive to manufacture.

And still another object of the invention is the provision of a shipping pallet that is completely recyclable.

A further object of the present invention is the provision of a shipping pallet that is free of sharp projections and, therefore, greatly reduces damage to the products being shipped.

And a further object of the present invention is the provision of a shipping pallet that is easily and quickly customized.

Still a further object of the present invention is the provision of a shipping pallet that is safer to handle and reduces injuries to workmen using the shipping pallet.

SUMMARY OF THE INVENTION

Briefly, to achieve the desired objects of the instant invention, in accordance with a preferred embodiment thereof, first provided is a recyclable lightweight pallet having a plurality of elongated runners and elongated mating crosspieces. Each elongated runner includes a plurality of elongated parallel juxtaposed runner sections of fiber board, with laterally extending assembled openings defined therein and longitudinally spaced apart therealong. The elongated mating crosspieces each define opposed assembled ends, each crosspiece including a plurality of elongated parallel juxtaposed crosspiece sections of fiber board, with each assembled end of each crosspiece being formed to mate with an assembled opening in one of the plurality of runners. The elongated runners and elongated mating crosspieces are formed into a generally rectangular pallet by engaging appropriate ones of the assembled ends in appropriate assembled openings.

Also, to achieve the desired objects of the instant invention a method of fabricating a recyclable lightweight pallet is provided, including the steps of providing at least one flat piece of fiber board. A plurality of first elongated sections are cut from the flat piece of fiber board each with a plurality of laterally extending openings formed therethrough and a plurality of second elongated sections are cut from the flat piece of fiber board each with a plurality of laterally extending openings formed therethrough. A plurality of elongated runners are then assembled, each being formed by assembling a plurality of the first elongate sections and at least one of the second elongated sections in parallel juxtaposed relationship to define an elongated runner with a plurality of longitudinally spaced apart laterally extending assembled openings defined therein. A plurality of elongated crosspiece sections are cut from the fiber board. The plurality of the crosspiece sections are assembled in parallel juxtaposed relationship to form a plurality of elongated mating crosspieces each defining opposed assembled ends, with each assembled end of each crosspiece being formed to mate with an assembled opening in one of the plurality of runners. A plurality of elongated runners and a plurality of elongated crosspieces are then assembled into a generally rectangular pallet by mating the opposed assembled ends of the plurality of crosspieces into assembled openings of the plurality of elongated runners.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which:

FIG. 4 is a sectional view of the pallet as seen from the line 4—4 in FIG. 2;

FIG. 5 is a sectional view of the pallet as seen from the line 5—5 in FIG. 2;

FIGS. 6 and 7 are sectional views of the pallet as seen from the line 7—7 of FIG. 2, illustrating inserted and rotated positions, respectively, during an assembly procedure;

FIGS. 8, 9 and 10 are side elevational views of sections of a component of the pallet of FIG. 1, prior to assembly;

FIGS. 11, 12 and 13 are side elevational views of sections of another component of the pallet of FIG. 1, prior to assembly;

FIG. 14 is a side elevational view of a section of still another component of the pallet of FIG. 1, prior to assembly;

FIG. 15 is a perspective view illustrating the assembly of the sections of FIGS. 8, 9 and 10 into a completed pallet component;

FIG. 16 is a perspective view illustrating the assembly of the sections of FIGS. 11, 12 and 13 into a completed pallet component ;

FIG. 17 is a perspective view of the completed component from the assembly of FIG. 15;

FIG. 18 is a perspective view of the completed component from the assembly of FIG. 16;

FIGS. 19 and 20 are perspective views of steps in a procedure for assembling pluralities of the components of FIGS. 17 and 18 into a shipping pallet;

FIG. 21 is a perspective view illustrating the assembly of a plurality of the sections of FIG. 14 into a completed pallet component;

FIG. 22 is a perspective view of the completed component from the assembly of FIG. 21;

FIGS. 23 and 24 are perspective views of steps in a procedure for assembling the component of FIG. 22 into the shipping pallet of FIG. 20;

FIG. 24 is a perspective view of the complete shipping pallet resulting from the assembly step of FIG. 23;

FIG. 31 is an enlarged perspective view, portions thereof broken away and shown in section, of the relative fit and interaction of mating components of a pallet;

FIG. 32 is a greatly enlarged view, portions thereof broken away, of an assembled component of a pallet;

FIG. 33 is a top plan view of a plurality of sections of a component for another embodiment of a pallet embodying the present invention;

FIG. 34 is a greatly enlarged view of a portion of the sections illustrated in FIG. 33;

FIG. 35 is a sectional view as seen from the line 35–35 of FIG. 34;

FIG. 36 is an enlarged perspective view of the plurality of sections illustrated in FIG. 33 assembled into a completed pallet component;

FIG. 37 is and end view of the plurality of sections of FIG. 33 during the assembling steps;

FIG. 38 is a greatly enlarged sectional view as seen from the line 38—38 of FIG. 36, portions thereof broken away;

FIG. 39 is a greatly enlarged sectional view as seen from the line 39—39 of FIG. 36, portions thereof broken away;

FIGS. 48 through 52 are perspective views illustrating various steps in the assembly of still another embodiment of a pallet embodying the present invention.

DETAILED DESCRIPTION OF THE PREFERRED EMBODIMENTS

Figure 1:
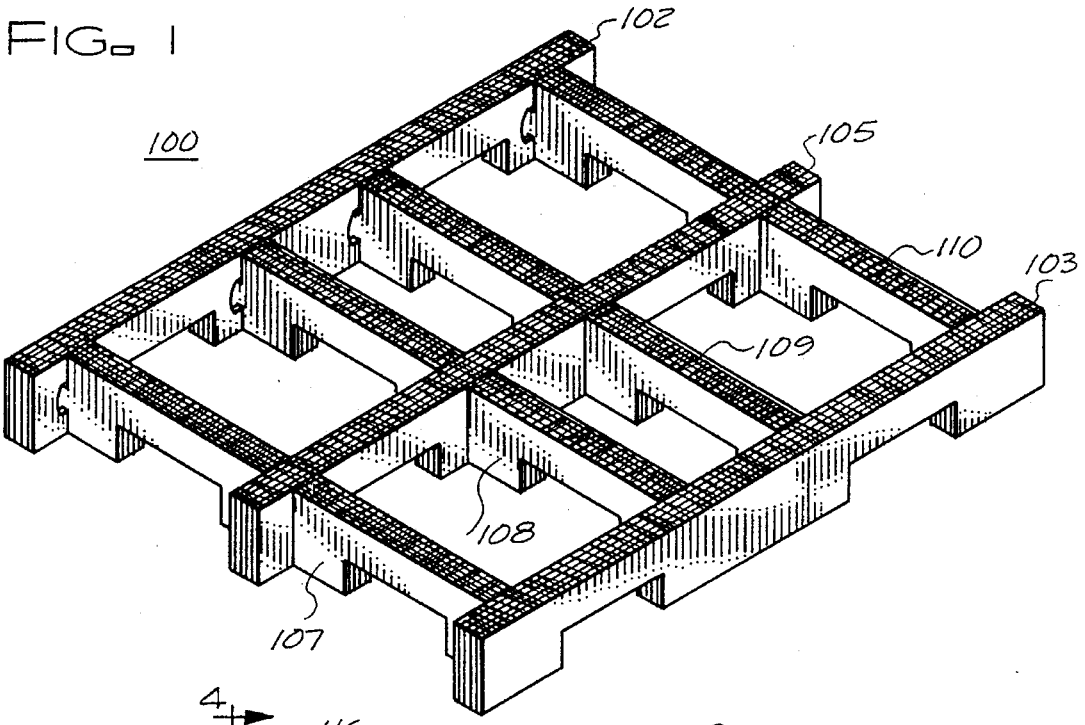
FIG. 1 is a perspective view of a shipping pallet embodying the present invention, the illustration being presented for purposes of reference and orientation in connection with the instant disclosure.
Figure 2:
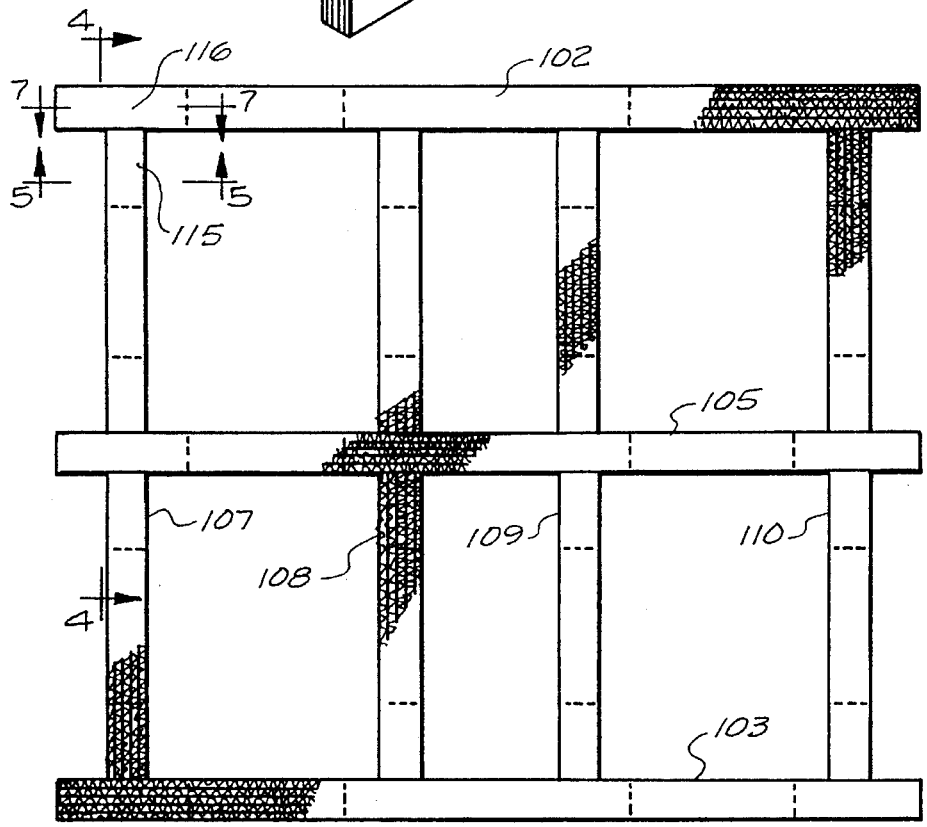
FIG. 2 a top plan view of the pallet of FIG. 1.
Figure 3:
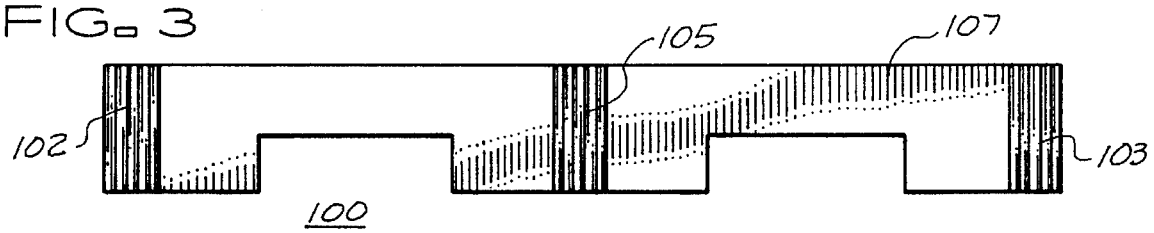
FIG. 3 is a side elevation view of the pallet of FIG. 1.

Referring specifically to FIGS. 1, 2 and 3, a shipping pallet 100 is illustrated having two outer elongated runners 102 and 103, a central runner 105, positioned between runners 102 and 103 and spaced equally therefrom, and four mating crosspieces 107 through 110. Each of the crosspieces 107 through 110 are matingly engaged with each of the runners 102, 103 and 105 to fixedly and rigorously form pallet 100, which is very strong and maintains large stacking strengths. Further, each end portion of each crosspiece 107 through 110 is interlockingly engageable with each of the runners 102 and 103 to maintain pallet 100 fixedly in an assembled form. Because each of the crosspiece end portions and the runners are substantially similar, one end portion 115 of crosspiece 107 engaged in one end portion 116 of runner 102 is utilized in FIGS. 4–7 as an example to illustrate the interlocking engagement more fully.

Referring specifically to FIG. 4, an enlarged sectional view is illustrated, as seen from the line 4—4 in FIG. 2. End portion 115 of crosspiece 107 is illustrated in interlocking engagement with end portion 116 of runner 102. End portion 115 of crosspiece 107 includes an assembled T-shaped extension 120 at the outer extremity. T-shaped extension 120 is formed with a body 121 extending axially outwardly from the extremity of end portion 115, defined generally by laterally outwardly extending shoulders 123, with arms 122 extending laterally outwardly in a plane including crosspiece 107. T-shaped extension 120 of end portion 115 is engaged in an assembled opening 125 in end portion 116 of runner 102.

As can be seen more specifically in FIG. 5, assembled opening 125 includes an inlet aperture 126 which is formed generally in the shape of a horizontal slot having a width slightly larger than the thickness of T-shaped extremity 120 and slightly longer than the length of arms 122 of T-shaped extremity 120. For reasons which will become apparent presently, the ends of inlet aperture 126 are arcuate, or rounded to form opposed arcs of a circle. An inner portion 127 of assembled opening 125 can be seen in more detail in FIGS. 6 and 7.

FIG. 6 is a partially engaged view and FIG. 7 is a fully engaged view, of T-shaped extension 120 and assembled opening 125, as seen from the line 7—7 of FIG. 2. Because FIGS. 6 and 7 are sectional views approximately through the center of end portion 116 of runner 102, and through assembled opening 125, slot-shaped inlet aperture 126 is removed and a cross-section of assembled opening 125 at approximately the center is illustrated. The center portion of assembled opening 125 is generally circular with a diameter slightly larger than the greatest length of arms 122 of T-shaped extension 120. Further, assembled opening 125 has radially inwardly extending stops 128 formed, in this specific embodiment, at approximately 135°and 315°.

T-shaped extension 120 is engaged in assembled opening 125 by positioning arms 122 parallel with slot-shaped inlet aperture 126 and inserting arms 122 into inlet aperture 126 until shoulders 123 are butted against the side, or inner surface, of end portion 116 of runner 102. This position is illustrated in FIG. 6 and, from this illustration, it can be seen that arms 122 are engaged with stops 128 to prevent clockwise rotation of crosspiece 107 (in FIG. 6) relative to runner 102. However, crosspiece 107 is free to rotate in a counter-clockwise direction, as illustrated in FIG. 7, until arms 122 engage the opposite surfaces of stop 128. With crosspiece 107 rotated into the fully counter-clockwise position illustrated in FIG. 7, arms 122 of T-shaped extension 120 are matingly engaged in assembled opening 125 and cannot be withdrawn. That is, arms 122 now extend orthogonal to slot-shaped inlet aperture 126 and are, therefore, held fixedly in the assembled position.

Referring to FIGS. 8, 9 and 10, elongated runner sections 130, 131 and 132, a plurality of which are utilized to form elongated runners 102 and 103, are illustrated, respectively. Since runners 102 and 103 are basically similar, only differing in that they are rotated 180° during assembly, only runner 102 will be described in detail. Elongated runner section 130 includes four slot-shaped inlet apertures 126, one of which is positioned adjacent either end thereof and a spaced apart pair on either side of approximately the center thereof. A pair of downwardly opening channels 135 are formed in the lower edge of runner section 130 to form, in final assembled pallet 100 a downwardly opening channel for receiving a fork lift. One runner section 130 is utilized in each runner 102 and 103 to form the inner surface thereof.

Referring specifically to FIG. 9, elongated runner section 131 is illustrated having four openings which define inner portion 127 of assembled openings 125. The four openings through runner section 131 are positioned to register with slot-shaped inlet apertures 126 of runner section 130 when runner sections 130 and 131 are positioned in overlying registery. It should be noted that the two openings 127 to the right of center in FIG. 9 are positioned so that stops 128 formed therein are rotated approximately 90° clockwise with respect to stop 128 in openings 127 to the left of center. A pair of downwardly opening channels 136 are formed in the lower edge of runner section 131 to form, in final assembled pallet 100 a downwardly opening channel for receiving a fork lift. In this specific embodiment of pallet 100, three elongated runner sections 131 are utilized in each runner 102 and 103.

Referring specifically to FIG. 10, elongated runner section 132 is illustrated. No openings are formed in runner section 131 so that an outer surface is positioned to complete assembled openings 135 when runner sections 130 and 131 are positioned in overlying registery with runner section 132. A pair of downwardly opening channels 137 are formed in the lower edge of runner section 132 to form, in final assembled pallet 100 a downwardly opening channel for receiving a fork lift. In this specific embodiment of pallet 100, one runner sections 132 is utilized to form the outer surface of each runner 102 and 103.

Referring to FIGS. 11, 12 and 13, elongated crosspiece sections 140, 141 and 142, a plurality of which are utilized to form elongated mating crosspieces 107, 108, 109 and 110, are illustrated, respectively. Since mating crosspieces 107, 108, 109 and 110 are basically similar, only crosspiece 107 will be described in detail. Crosspiece section 140 includes a T-shaped section 145 extending outwardly from either end thereof. The ends of crosspiece section 140 are generally defined by laterally projecting shoulder sections 146. Each of the T-shaped sections 145 have a body 148, which extends longitudinally outwardly from shoulder sections 146 a distance slightly greater than the thickness of runner section 130, and arms 147 extending laterally outwardly therefrom in the plane of crosspiece section 140. An upwardly opening slot 150 is formed approximately centrally in crosspiece section 140 to receive runner 105, as will be explained presently. Also, a pair of downwardly opening channels 151 are formed in the lower edge of crosspiece section 140 to form, in final assembled pallet 100 a downwardly opening channel for receiving a fork lift.

Referring specifically to FIG. 12, crosspiece section 141 includes a T-shaped section 155 extending outwardly from either end thereof. The ends of crosspiece section 141 are generally defined by laterally projecting shoulder sections 156. Each of the T-shaped sections 155 have a body 158, which extends longitudinally outwardly from shoulder sections 156 a distance slightly greater than the thickness of runner section 130, and arms 157 extending laterally outwardly therefrom in the plane of crosspiece section 141. Here it should be noted that arms 147 of crosspiece 140 extend laterally outwardly a slightly greater distance than arms 157 of crosspiece section 141. An upwardly opening slot 160 is formed approximately centrally in crosspiece section 141 to receive runner 105, as will be explained presently. Also, a pair of downwardly opening channels 161 are formed in the lower edge of crosspiece section 141 to form, in final assembled pallet 100 a downwardly opening channel for receiving a fork lift.

Referring specifically to FIG. 13, crosspiece section 142 includes a T-shaped section 165 extending outwardly from either end thereof. The ends of crosspiece section 142 are generally defined by laterally projecting shoulder sections 166. Each of the T-shaped sections 165 have a body 168, which extends longitudinally outwardly from shoulder sections 166 a distance slightly greater than the thickness of runner section 130, and arms 167 extending laterally outwardly therefrom in the plane of crosspiece section 142. Here it should be noted that arms 157 of crosspiece 141 extend laterally outwardly a slightly greater distance than arms 167 of crosspiece section 142. An upwardly opening slot 170 is formed approximately centrally in crosspiece section 142 to receive runner 105, as will be explained presently. Also, a pair of downwardly opening channels 171 are formed in the lower edge of crosspiece section 142 to form, in final assembled pallet 100 a downwardly opening channel for receiving a fork lift.

Referring specifically to FIG. 14, an elongated runner section 165 for elongated runner 105 is illustrated. Runner section 165 is approximately the same length and width as runner sections 130, 131 or 132. Also, runner section 165 has a pair of downwardly opening channels 166 formed in the lower edge thereof to form, in final assembled pallet 100 a downwardly opening channel for receiving a fork lift. Four downwardly opening slots 167 are formed in the lower edge of runner section 165 and positioned to mate with upwardly opening slots 150, 160 and 170 of crosspiece sections 140, 141 and 142, as will be explained presently.

Each of the runner sections 130, 131 and 132, each of the crosspiece sections 140, 141 and 142 and each of the runner sections 165 are formed of fiber board. The term "fiber board" as used herein includes corrugated paper, corrugated fiber board, fiber board, heavy paper board, any convenient combination of the above, and any other material formed of paper type material.

In one specific method of fabricating pallet 100, one runner section 130, three runner sections 131 and one runner section 132 are assembled as illustrated in FIG. 15. All of the openings through the various runner sections are positioned in register to define four assembled openings 125 in each runner. Also, all of the downwardly opening channels are registered to form assembled channels 175. Runner sections 130, 131 and 132 are affixed together by any convenient means, such as gluing or the like to form a completed runner 102, as illustrated in FIG. 17. Runner 103 is fabricated utilizing a similar method. Some typical preferred starch adhesives which can be utilized are Mitex, sold commercially by Harper-Love Adhesive Corp. of Charlotte, N.C., or Vinamyl, sold commercially by National Starch & chemical of Bridgewater, N.J. Also, some preferred laminating adhesives which can be utilized are 3724L Polymer Adhesive, sold commercially by H. B. Fuller Company of La Mirada, Calif. Other polymer adhesives are commercially available and less expensive adhesives can be formulated by adding clay fillers. Also, in some special applications it may be desirable to provide the assembled runners with special coatings as, for example, wax cascading or saturating. The advantages of such coatings are water resistance but this may render the final pallet non-recyclable. Imulsified Wax which may be utilized for the coating is, for example, Michelman Vapor Coat as provided commercially by Michelman Inc. of Cincinnati, Ohio.

One crosspiece section 140, two crosspiece sections 141 and two crosspiece section 142 are assembled as illustrated in FIG. 16. All of the T-shaped sections of the various crosspiece sections are positioned in register to define an assembled T-shaped extension 120 at each end of the crosspiece. Also, all of the downwardly opening channels are registered to form assembled channels 176 and all of the upwardly opening slots are registered to form assembled slot 177. By placing crosspiece section 140 in the middle, with crosspiece sections 141 on either side thereof and crosspiece sections 142 on the outer sides of crosspiece sections 141, the outer ends of arms 122 of assembled T-shaped extensions 120 at either end of crosspiece 107 are generally arcuate to provide maximum locking within assembled openings 125. Crosspiece sections 140, 141 and 142 are affixed together by any convenient means (generally similar to that used for runner sections 130, 131 and 132), such as gluing or the like to form a completed crosspiece 107, as illustrated in FIG. 18. Crosspieces 108, 109 and 110 are fabricated utilizing a similar method.

With runners 102 and 103 and crosspieces 107, 108, 109 and 110 fabricated as explained above, assembly of pallet 100 can begin. Runners 102 and 103 are positioned in an upright and spaced apart position with the four inlet apertures 126 in each runner 102 and 103 facing each other and channels 175 opening downwardly, as illustrated in FIG. 19. Crosspieces 107, 108, 109 and 110 are positioned between runners 102 and 103 with crosspieces 107 and 108 rotated 180° relative to crosspieces 109 and 110. That is, the lower edges of crosspieces 107 and 108 face to the left in FIG. 19 and the lower edged of crosspieces 109 and 110 face to the right.

Figures 20, 21, 22, 23, 24:
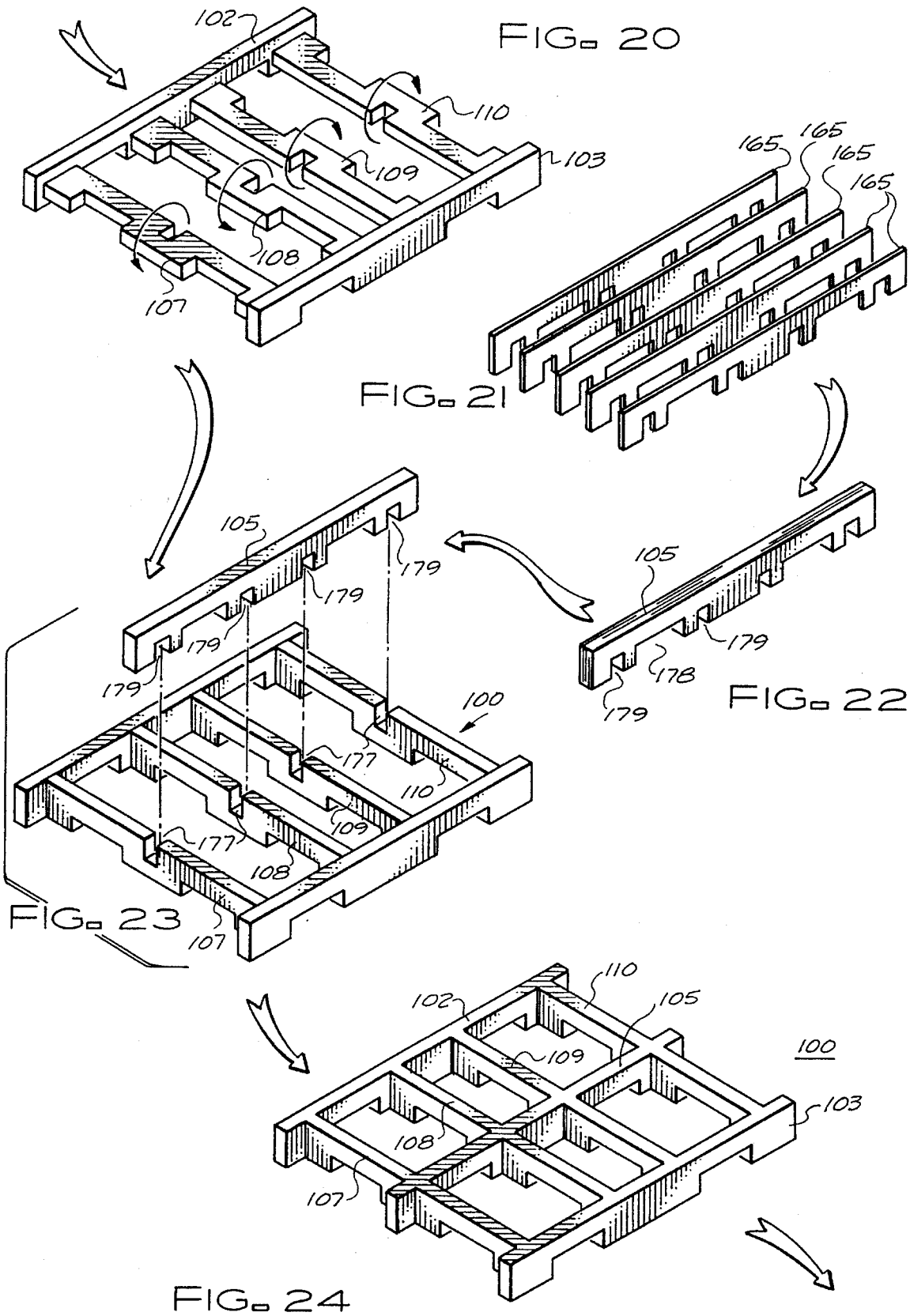

Referring specifically to FIG. 20, the T-shaped extension at each end of each crosspiece 107, 108, 109 and 110 is inserted into an assembled opening in runners 102 and 103. Holding runners 102 and 103 fixedly in position, crosspieces 107 and 108 are rotated counterclockwise, in FIG. 20, and crosspieces 109 and 110 are rotated clockwise. The rotation of crosspieces 107, 108, 109 and 110 fixedly engages the T-shaped extensions in the assembled openings. Five elongated runner sections 165 (see FIG. 14) are assembled together with the various channels and slots in register (see FIG. 21) by any convenient means (generally similar to that used for runner sections 130, 131 and 132), such as gluing or the like to form central runner 105, having downwardly opening channels 178 and downwardly opening slots 179 as illustrated in FIG. 22. Central runner 105 is then assembled in pallet 100, as illustrated in FIG. 23, with each downwardly opening slot 179 engaged in an upwardly opening slot 177 of crosspieces 107, 108, 109 and 110 to form a completely assembled pallet 100, as illustrated in FIG. 24. Because crosspieces 107 and 108 are rotated oppositely from crosspieces 109 and 110 during assembly, central runner 105 holds all of crosspieces 107, 108, 109 and 110 fixedly locked in an assembled position.

Figures 25, 26, 27, 28, 29, 30:
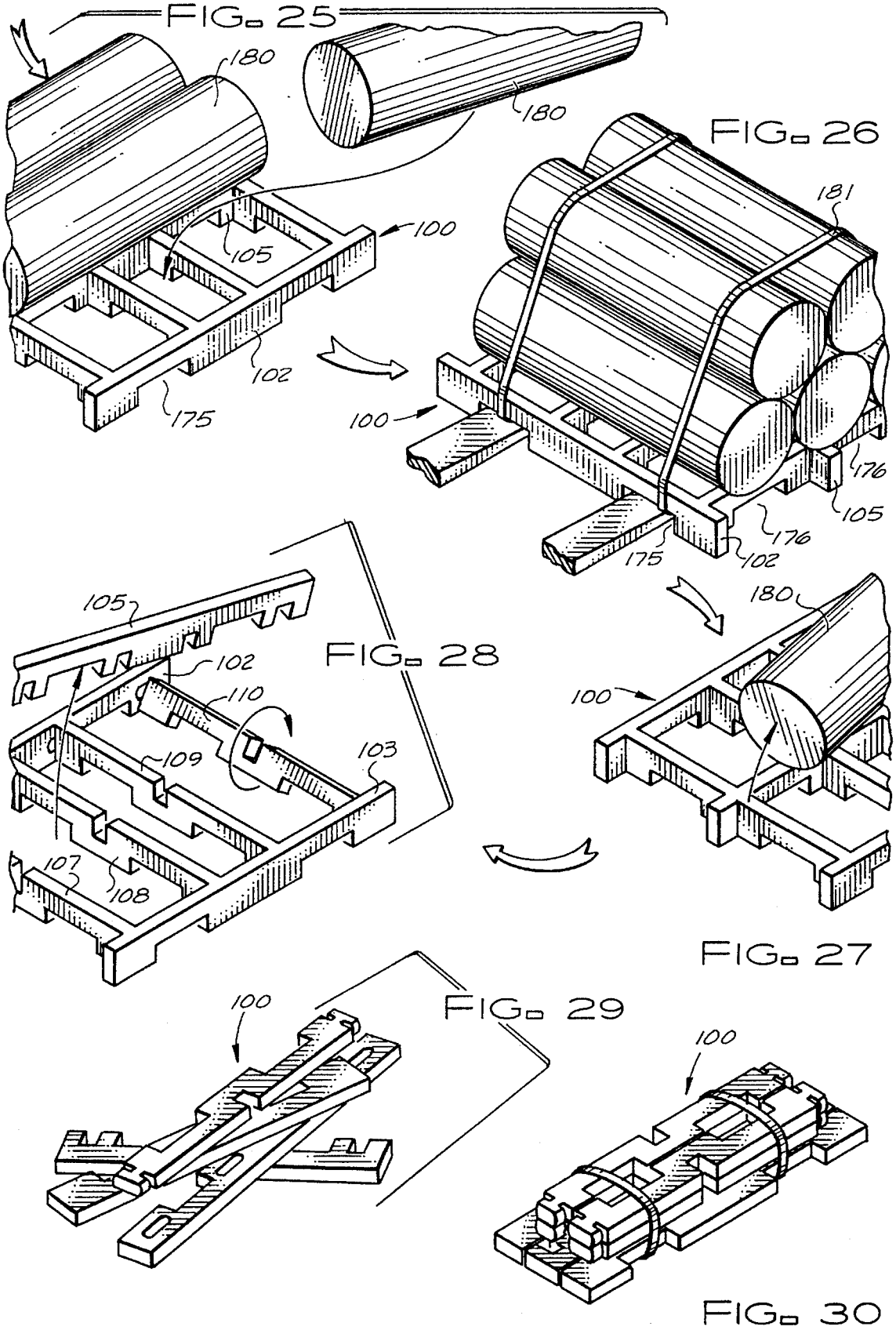
FIG. 25 is a perspective view, portions thereof broken away, of the shipping pallet of FIG. 24 being loaded with a product.
FIG. 26 is a perspective view of the pallet of FIG. 25 completely loaded, secured and being engaged by a forklift.
FIGS. 27, 28 29 and 30 illustrate various steps in the unloading, disassembling and storage of the pallet of FIG. 26.

Pallet 100 is now ready for loading of articles 180 thereon, as illustrated in FIG. 25. Once a desired, or a maximum, number of articles 180 are loaded onto pallet 100, the articles are held in place by any convenient means, such as steel straps 181. Steel straps 181 are positioned so as to encircle pallet 100 and articles 180 and, for convenience, are located in each of downwardly opening channels 175 of runners 102 and 103 and channels 178 of central runner 105 as can be seen in FIG. 26. It should be noted that pallet 100 can still be lifted by a fork lift using either channels 175 or channels 176 in crosspieces 107, 108, 109 and 110. Upon reaching a shipping destination, steel straps 181 are removed and articles 180 are unloaded as illustrated in FIG. 27. With pallet 100 unloaded, central runner 105 is disengaged, as illustrated in FIG. 28, crosspieces 107, 108, 109 and 110 are rotated oppositely to the rotation utilized in assembly, and pallet 100 is prepared for storage, or return, as illustrated in FIGS. 29 and 30. Disassembled pallet 100 forms a very convenient and light package for handling, storage, and/or shipping.

An enlarged perspective view of an assembled opening 125 (portions thereof removed and shown in section) in runner 102 and a mating T-shaped extension 120 at one end of crosspiece 107 is illustrated in FIG. 31. Each runner or crosspiece section utilized is formed of fiberboard, which in this preferred embodiment includes corrugated paper or corrugated fiber board. A greatly enlarged perspective view of a portion of runner 102 (all runner or crosspiece section being similar in this embodiment) is illustrated in FIG. 32. In this specific embodiment, each runner section 130, 131 and 132 of runner 102 includes doublewall corrugated paper. Taking runner section 132 for example, the doublewall corrugated paper includes outer walls or liners 185 and 186 with a third wall 187 positioned parallel thereto and midway therebetween. Flutes or corrugations 188 and 189 are fixedly positioned between walls 185 and 187 and walls 186 and 187. Adjacent runner sections are affixed together by means of a layer of adhesive 190, generally as described previously.

It should be understood that a great variety of fiber board can be utilized to fabricate the disclosed pallets and the material utilized is generally application specific. While doublewall corrugated paper is illustrated and described, it should be understood that single wall corrugated paper can be utilized, for example, for lighter applications, or triple wall corrugated paper can be utilized for heavier applications. Also combinations of the above can be utilized for portions of the pallets bearing different amounts of force. Preferred flutes in A/A doublewall or A/C doublewall corrugated paper purchased commercially from several sources. Also, preferred paper combinations include 69-26-69-26-69 but other liners or combinations of liners could be used including but not limited to 33, 42, 45, 57, 58, 69, 74, 76, 90, or 96# liners or anything in between. Also, 26#medium or flutes is preferred but 30#, 33#, or 40# medium could be used or anything in between.

Referring to FIGS. 33 through 47, another embodiment of a pallet 200 is illustrated wherein components similar to those explained above in pallet 100 are designated with similar numbers and a prefix of "2" is substituted in place of the "1" to designate a second embodiment. More specifically, FIG. 33 illustrates five runner sections including a runner section 230, three runner sections 231 and a runner section 232. All five sections are attached together by fiber board which is cut so that at least one common wall between adjacent sections remains uncut. The uncut walls between the sections hold the sections in one complete piece for ease and strength in assembly. Also, living hinges 211 are formed between adjacent runner sections 230 and 231 and between the other two runner sections 231.

A greatly enlarged detail view of a living hinge 211 between adjacent runner sections 231 is illustrated in FIG. 34. Living hinge 211 is formed by leaving a portion 212 of the fiber board between the adjacent sections 231 uncut. A short cut 213 is made perpendicular to the cut between adjacent sections and approximately at each end of uncut portion 212. Two parallel spaced apart scores 214 are formed in at least the upper wall of the fiber board material in portion 212. As can be seen in FIG. 35, scores 214 are essentially bent portions of upper wall 285 which partially crushes flutes 288 and allows the fiber board to bend at living hinge 211 . While scores 21 4 are shown extending longitudinally with respect to flutes 288, one skilled in the art will understand that scores 214 may be rotated 90 degrees, to extend substantially perpendicular with respect to flutes 288. The five sections are then relatively easily accordioned together as illustrated in FIG. 37 to form assembled elongated runner 202 as illustrated in FIG. 36.

Referring specifically to FIG. 38, an enlarged cross-sectional view of living hinge 212 as seen from the line 38—38 of FIG. 36 is illustrated. From this view it can be seen that the fiber board material forming adjacent sections 230, 231 and adjacent sections 231, 231 is not cut but simply bends to hold the adjacent sections firmly in place. It should be understood that additional living hinges (not shown) can be formed in a similar fashion in lower wall 286 between adjacent sections 231, 231 and 231, 232 if desired. Such additional living hinges would have to be positioned, for example, on opposite sides of channels 236 and 237.

Referring specifically to FIG. 39, which is an enlarged cross-section of runner 202 as seen from the line 39—39 in FIG. 36, details of the fiber board forming runner 202 are illustrated. From this view it can be seen that outer wall 286 of runner section 232 is uncut and shares an integral portion 283 with outer wall 285 of adjacent section 231. Similarly, the other two adjacent sections 231 share an uncut integral portion 284. Similar integral portions (not shown) are formed at the upper edges between adjacent portions. For purposes of this disclosure, integral portions 283 and 284 also come within the definition of a living hinge. Integral portions 283 and 284 and others hold the adjacent portions firmly together and, thereby, increase the strength of the assembled runner 202. Also, integral portions aid in the fixing process by holding adhesive layers 290 between adjacent sidewalls.

Figure 40:
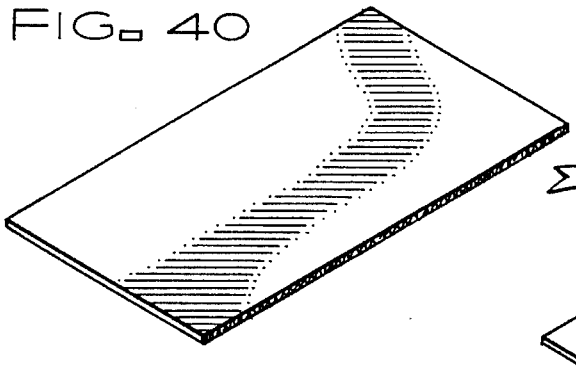
FIGS. 40 through 47 are perspective views illustrating various steps in the fabrication of the pallet component of FIG. 36.
Figure 41:
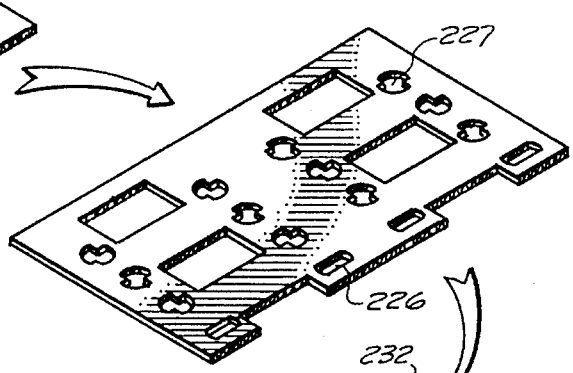
Figure 42:
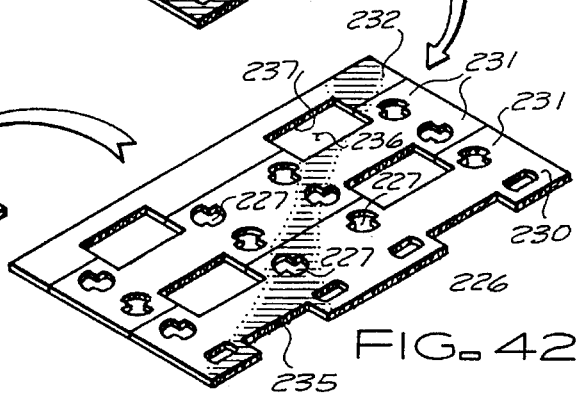
Figure 43:
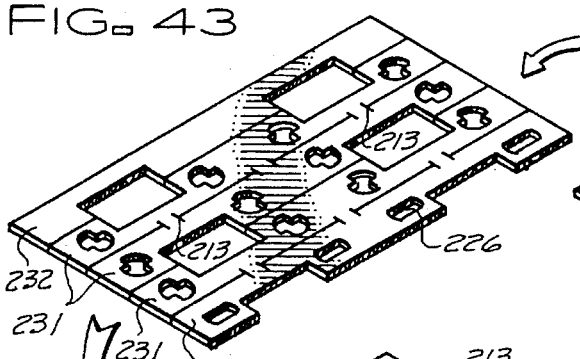
Figure 44:
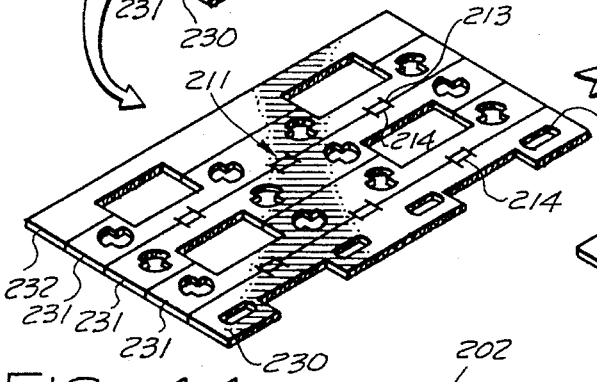
Figure 45:
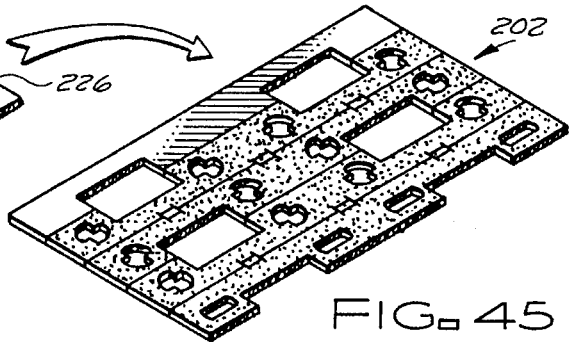
Figure 46:
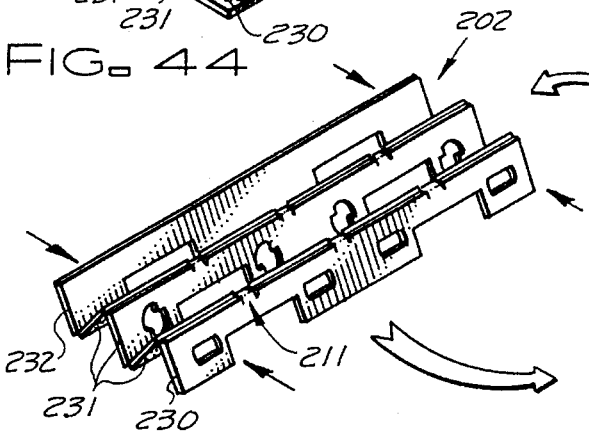
Figure 47:
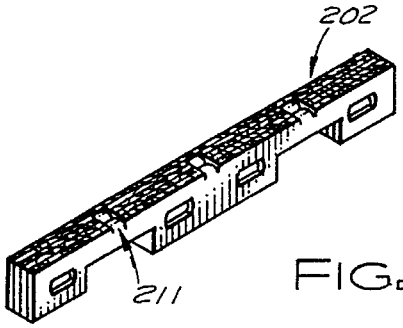

Referring to FIGS. 40 through 47, a step-by-step process for forming runner 202 is illustrated. At least one flat piece of fiber board is provided as illustrated in FIG. 40. A plurality of elongated sections 231 are defined in juxtaposition on the flat piece of fiber board each with a plurality of laterally extending openings 227 and slots 236 formed therethrough. An elongated section 230 is also defined with a plurality of laterally extending openings 226 and slots 235 formed therethrough. Section 230 is defined in juxtaposition to elongated sections 231 on the flat piece of fiber board. An elongated section 232 is also defined in juxtaposition to sections 231 and slots 237 are cut therethrough. Generally, the various openings and slots are cut or stamped out of the flat piece as a single unit, as illustrated in FIG. 41. Partial cuts (all but the bottom wall) between adjacent sections 232, 231 and 231, 231 are then made, as illustrated in FIG. 42, and the flat piece of fiber board is turned over. Partial cuts are made between adjacent sections 231, 231 and 231, 230 and short cuts 213 for living hinges 211 are formed simultaneously, as illustrated in FIG. 43. Scores 214 for living hinges 211 are formed next, as illustrated in FIG. 44. An appropriate adhesive is then applied to the upper surfaces of all of sections 231 and section 230, as illustrated in FIG. 45. The sections are then folded or accordioned together, as illustrated in FIG. 46, and the sections are firmly pressed together and held until the adhesive cures or dries, as illustrated in FIG. 47.

Mating crosspieces and a central runner are formed in a similar fashion. The various runners and mating crosspieces are then assembled into a pallet generally as explained above.

Referring to FIGS. 48 through 52, yet another embodiment of a pallet 300 is illustrated wherein components similar to those explained above in pallet 100 are designated with similar numbers and a prefix of "3" is substituted in place of the "1" to designate a third embodiment. More specifically, FIG. 48 illustrates five runner sections including a runner section 330, three runner sections 331 and a runner section 332. All five sections are attached together by fiber board which is cut and scored, generally as described in conjunction with FIGS. 40 through 44. Pallet 300 differs from pallet 200 in that a generally rectangularly shaped flat piece 317 of fiber board is attached along one edge to elongated section 332. Also, a plurality of tabs 318 are formed along the free edge of rectangularly shaped flat piece 317. Rectangularly shaped flat piece 317 is connected to section 332 by an uncut fiber board wall, or a living hinge, and tabs 318 are connected to rectangularly shaped flat piece 317 by an uncut fiber board wall, or a living hinge, as illustrated in FIG. 49.

Runners 302 and 303 are assembled with mating crosspieces 307, 308, 309 and 310 so that rectangularly shaped flat pieces 317 extend outwardly from the assembly, as illustrated in FIG. 51. Also, a central runner 305 is positioned in the assembly. Central runner 305 differs from previously described central runners in that slots 338 are formed in two of the center runner sections (see FIG. 50) so as to open upwardly in FIG. 51. Rectangularly shaped flat pieces 317 are then folded over the top of the assembly and tabs 318 are inserted into slots 338. Rectangularly shaped flat pieces 317 form a complete, planar upper surface for pallet 300, as illustrated in FIG. 52. In many applications planar upper surfaces are desired and/or required to hold specific loads. It will of course be understood that a single rectangularly shaped flat pieces could be utilized to form the complete, planar upper surface if desired.

Various modifications and changes to the embodiments herein chosen for purposes of illustration will readily occur to those skilled in the art. For example, additional or fewer sections might be utilized in the fabrication of the various runners and mating crosspieces. Also, additional or fewer mating crosspieces and central runners might be utilized.

Thus, a new and improved shipping pallet has been disclosed which is relatively lightweight and easy to handle. Further, the new and improved shipping pallet is relatively inexpensive to store and ship. Also, the new and improved shipping pallet is relatively inexpensive to manufacture and completely recyclable. Because of the novel construction of the new pallet it is free of sharp projections and, therefore, greatly reduces damage to the products being shipped and is safer to handle and reduces injuries to workmen using the shipping pallet. Also, because of the novel construction of the new pallet it is easily and quickly customized.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. A recyclable lightweight pallet comprising:

a plurality of elongated runners, each including a plurality of first elongated parallel juxtaposed runner sections of fiber board, each with laterally extending generally circular openings formed therethrough and longitudinally spaced apart therealong, the circular openings including radially inwardly extending stops, and at least a second elongated parallel juxtaposed section with laterally extending slot-shaped openings formed therethrough and longitudinally spaced apart therealong, with the section having the slot-shaped openings being positioned to form an inner surface of the elongated runner, the slot-shaped openings and the circular openings being axially aligned to form an assembled opening; and a plurality of elongated mating crosspieces defining opposed assembled ends, each crosspiece including a plurality of elongated parallel juxtaposed crosspiece sections of fiber board, with each assembled end of each crosspiece being formed to mate with an assembled opening in one of the plurality of runners, the runners and mating crosspieces forming a generally rectangular pallet.

2. A recyclable lightweight pallet as claimed in claim 1 wherein the assembled ends of the plurality of elongated mating crosspieces include a generally T-shaped extension at each end of each crosspiece, the T-shaped extension being positioned so that arms of the T extend laterally in a plane including the crosspiece and a body of the T is long enough to extend through a slot-shaped opening of an elongated runner and position the arms in the circular openings.

3. A recyclable lightweight pallet as claimed in claim 2 wherein the body of the generally T-shaped extension and the slot-shaped opening of an elongated runner mate to allow rotation of the generally T-shaped extension within the assembled opening.

4. A recyclable lightweight pallet as claimed in claim 1 wherein the elongated runners each include a third elongated parallel section juxtaposed with an outer surface of the plurality of first elongated parallel juxtaposed sections to form an outer surface of the elongated runners, the third section further forming an outer wall for each of the assembled openings.

5. A recyclable lightweight pallet as claimed in claim 4 wherein each of the plurality of elongated runners and each of the plurality of elongated mating crosspieces include at least five elongated parallel juxtaposed sections.

6. A method of fabricating a recyclable lightweight pallet including the steps of:

providing at least one flat piece of fiber board;

cutting a plurality of first elongated sections from the flat piece of fiber board each with a plurality of laterally extending generally circular openings formed therethrough, the circular openings including radially inwardly extending stops, and cutting a plurality of second elongated sections from the flat piece of fiber board each with a plurality of laterally extending openings formed therethrough;

assembling a plurality of elongated runners, each being formed by assembling a plurality of the first elongate sections and at least one of the second elongated sections in parallel juxtaposed relationship to define an elongated runner with a plurality of longitudinally spaced apart laterally extending assembled openings defined therein;

cutting a plurality of elongated crosspiece sections from the fiber board;

assembling a plurality of the crosspiece sections in parallel juxtaposed relationship to form a plurality of elongated mating crosspieces each defining opposed assembled ends, with each assembled end of each crosspiece being formed to mate with an assembled opening in one of the plurality of runners; and assembling a plurality of elongated runners and a plurality of elongated crosspieces by mating the opposed assembled ends of the plurality of crosspieces into assembled openings of the plurality of elongated runners to form a generally rectangular pallet. assembled ends, with each assembled end of each crosspiece being formed to mate with an assembled opening in one of the plurality of runners; and assembling a plurality of elongated runners and a plurality of elongated crosspieces by mating the opposed assembled ends of the plurality of crosspieces into assembled openings of the plurality of elongated runners to form a generally rectangular pallet.

7. A method of fabricating a recyclable lightweight pallet as set forth in claim 6 wherein the step of cutting a plurality of second elongated sections from the flat piece of fiber board includes cutting a plurality of second elongated sections from the flat piece of fiber board each with laterally extending slot-shaped openings formed therethrough.

8. A method of fabricating a recyclable lightweight pallet as set forth in claim 7 wherein the step of cutting a plurality of elongated crosspiece sections of fiber board includes cutting each crosspiece section with a generally T-shaped extension at each end of each crosspiece.

* * * * *